US010273786B2

(12) United States Patent
McNamee

(10) Patent No.: US 10,273,786 B2
(45) Date of Patent: Apr. 30, 2019

(54) INFLOW CONTROL DEVICE HAVING EXTERNALLY CONFIGURABLE FLOW PORTS AND EROSION RESISTANT BAFFLES

(71) Applicant: Weatherford Technology Holdings, LLC, Houston, TX (US)

(72) Inventor: Stephen McNamee, Rhode (IE)

(73) Assignee: Weatherford Technology Holdings, LLC, Houston, TX (US)

( * ) Notice: Subject to any disclaimer, the term of this patent is extended or adjusted under 35 U.S.C. 154(b) by 199 days.

(21) Appl. No.: 15/346,228

(22) Filed: Nov. 8, 2016

(65) Prior Publication Data

US 2017/0130566 A1 May 11, 2017

Related U.S. Application Data

(60) Provisional application No. 62/252,660, filed on Nov. 9, 2015.

(51) Int. Cl.
*E21B 43/08* (2006.01)
*E21B 34/06* (2006.01)
(Continued)

(52) U.S. Cl.
CPC ..... *E21B 43/08* (2013.01); *E21B 34/06* (2013.01); *E21B 43/12* (2013.01); *E21B 2034/002* (2013.01)

(58) Field of Classification Search
CPC ..... E21B 43/08; E21B 34/06; E21B 43/12; E21B 2034/002
See application file for complete search history.

(56) References Cited

U.S. PATENT DOCUMENTS 3,095,007 A 6/1963 Allen
5,435,393 A 7/1995 Brekke et al.
(Continued)

FOREIGN PATENT DOCUMENTS

AU 672983 3/1994
CA 2762480 A1 6/2013
(Continued)

OTHER PUBLICATIONS

Cesari, Michele, "Water/Gas Breakthrough in Horizontal Wells Analysis of the completion strategies used to mitigate the problem," Master in Petroleum Engineering 2008-09, Oct. 21, 2009, 43 pages.
(Continued)

*Primary Examiner* — Yong-Suk Ro
(74) *Attorney, Agent, or Firm* — Blank Rome, LLP

(57) ABSTRACT

A flow control apparatus for a borehole comprises a basepipe, a screen, a sleeve, and at least one baffle. The basepipe has a bore for conveying fluid and defines at least one opening for communicating fluid into the bore. The screen is disposed on the basepipe and screens fluid from outside the basepipe. The sleeve is disposed on the basepipe adjacent the screen and has at least one flow passage for communicating the fluid from the screen to the at least one opening in the basepipe. A shelf of the sleeve extends downstream from the at least one flow passage and covers at least a portion of the basepipe upstream from the at least one opening. The at least one baffle is disposed on the shelf and changes a direction of the flow exiting from the at least one flow passage.

20 Claims, 5 Drawing Sheets

(51) Int. Cl.

| | |
|---|---|
| ***E21B 43/12*** | (2006.01) |
| *E21B 34/00* | (2006.01) |

(56) References Cited

U.S. PATENT DOCUMENTS

| | | | | |
|---|---|---|---|---|
| 5,803,179 | A | 9/1998 | Echols et al. | |
| 6,371,210 | B1 | 4/2002 | Bode et al. | |
| 6,644,412 | B2 | 11/2003 | Bode et al. | |
| 6,715,544 | B2 | 4/2004 | Gillespie et al. | |
| 6,883,613 | B2 | 4/2005 | Bode et al. | |
| 7,240,739 | B2 | 7/2007 | Schoonderbeek et al. | |
| 7,428,924 | B2 | 9/2008 | Patel | |
| 7,469,743 | B2 | 12/2008 | Richards | |
| 7,578,343 | B2 | 8/2009 | Augustine | |
| 7,708,068 | B2 | 5/2010 | Hailey, Jr. | |
| 7,717,178 | B2 | 5/2010 | Gaudette et al. | |
| 7,987,909 | B2 | 8/2011 | Pineda et al. | |
| 9,175,543 | B2 | 11/2015 | Gano et al. | |
| 2002/0108755 | A1 | 8/2002 | Zisk | |
| 2002/0157837 | A1 | 10/2002 | Bode et al. | |
| 2004/0108107 | A1 | 6/2004 | Inittrisch | |
| 2004/0154806 | A1 | 8/2004 | Bode et al. | |
| 2007/0012453 | A1 | 1/2007 | Coronado et al. | |
| 2007/0246212 | A1 | 10/2007 | Richards | |
| 2007/0246407 | A1 | 10/2007 | Richards et al. | |
| 2008/0041588 | A1 | 2/2008 | Richards et al. | |
| 2008/0169099 | A1 | 7/2008 | Pensgaard | |
| 2008/0236843 | A1 | 10/2008 | Scott et al. | |
| 2008/0314590 | A1 | 12/2008 | Patel | |
| 2009/0000787 | A1 | 1/2009 | Hill et al. | |
| 2009/0008092 | A1 | 1/2009 | Haeberie et al. | |
| 2009/0050313 | A1 | 2/2009 | Augustine | |
| 2009/0095487 | A1 | 4/2009 | Xu et al. | |
| 2009/0151925 | A1 | 6/2009 | Richards et al. | |
| 2010/0212895 | A1 | 8/2010 | Vickery et al. | |
| 2011/0073308 | A1 | 3/2011 | Assal et al. | |
| 2011/0147006 | A1 | 6/2011 | O'Malley et al. | |
| 2011/0180271 | A1 | 7/2011 | Brekke et al. | |
| 2011/0099895 | A1 | 8/2011 | Shishov | |
| 2012/0006563 | A1 | 1/2012 | Patel et al. | |
| 2012/0061088 | A1 | 3/2012 | Dykstra et al. | |
| 2013/0319664 | A1 | 12/2013 | McNamee et al. | |
| 2015/0013978 | A1 | 1/2015 | Nenniger | |
| 2015/0034333 | A1* | 2/2015 | Fripp | E21B 43/12 166/373 |
| 2015/0292300 | A1* | 10/2015 | Franklin | E21B 43/08 166/244.1 |

FOREIGN PATENT DOCUMENTS

| | | | | |
|---|---|---|---|---|
| CN | 201236678 | | 5/2009 | |
| EP | 0588421 | A1 | 3/1994 | |
| EP | 1407806 | A1 | 4/2004 | |
| EP | 1672167 | A1 | 6/2006 | |
| EP | 2669466 | A2 * | 12/2013 | E21B 34/08 |
| GB | 2410762 | A | 10/2005 | |
| GB | 2437641 | A | 10/2007 | |
| GB | 2450589 | A | 12/2008 | |
| WO | 9208875 | | 5/1992 | |
| WO | 2005/071221 | A1 | 8/2005 | |
| WO | 2009103036 | | 8/2009 | |
| WO | 2011/106579 | A2 | 9/2011 | |
| WO | 2013/022446 | A1 | 2/2013 | |
| WO | 2013/074069 | A1 | 5/2013 | |

OTHER PUBLICATIONS

Schlumberger, "Inflow Control Devices-Raising Profiles," Oilfield Review, Winter 2009/2010, vol. 4, pp. 30-37.
Baker Hughes, "EQUALIZER-CF Completion Solution Reduced Pay Zone Losses in Mature Field," obtained from www.bakerhughes.com, (c) 2010, 1 page.
Aadnoy, Bemt S, "Autonomous Flow Control Valve or "intelligent" ICD," (c) 2008, 9 pages.
Birchenko, Vasily Mihailovich, "Analytical Modelling of Wells with Inflow Control Devices," Jul. 2010, pp. 1-134, Institute of Petroleum Engineering Heriot-Watt University.
Halliburton, "EquiFlow Inflow Control Devices and EquiFlow Inject System," obtained from www.halliburton.com, (c) 2009, 18 pages.
Halliburton, "EquiFlow Autonomous Inflow Control Device," obtained from www.halliburton.com, (c) 2011, 22 pages.
Weatherford, "Combating Coning by Creating Even Flow Distribution in Horizontal Sand-Control Completions," obtained from www.weatherford.com, (c) 2005-2008, 4 pages.
Schlumberger, "FloRite Inflow Control Device," obtained from www.slb.com/transcend, (c) 2009, 2 pages.
Schlumberger, "FluxRite Inflow Control Device," obtained from www.s1b.com/completions, (c) 2009, 2 pages.
Halliburton, "EquiFlow Inflow Control Devices," Advanced Completions, obtained from www.halliburton.com, (c) 2009, 2 pages.
Halliburton, "EquiFlow Inject System," Advanced Completions, obtained from www.halliburton.com, (c) 2009, 2 pages.
Halliburton, "PetroGuard Mesh Screen," Sand Control Screens, obtained from www.halliburton.com, (c) 2010, 2 pages.
Halliburton, "EquiFlow Sliding Side-Door Inflow Control Device," Advanced Completions, obtained from www.halliburton.com, (c) 2011, 2 pages.
Halliburton, "PetroGuard Screen and EquiFlow ICD with Remote-Open Valve" Advanced Completions, obtained from www.halliburton.com, (c) 2011, 2 pages.
The Journal of Petroleum Technology, "Novel inflow-control device extends well life," obtained from www.spe.org/ipt/2009/05/novel-inflow-control-device-extends-well-life/, May 18, 2009, 2 pages.
Schlumberger, "ResFlow Well Production Management System," obtained from www.slb.com/completions, (c) 2007, 4 pages.
Schlumberger, "ResInject Well Production Management System," obtained from www.slb.com/completions, (c) 2007, 2 pages.
Schlumberger, "Reslink-Screens and Injection and Inflow Control Devices," obtained from www.slb.com/transcend, (c) 2007, 8 pages.
Weatherford, "Retarding Water Production: Nozzle V's Channel ICD's," Jun. 30, 2009, 22 pages.
Weatherford, "Maxflo Screen with FloReg Device Improves Production by Achieving Even Flow Distribution in Offshore Openhole Well" obtained from www.weatherford.com, (c) 2008, 1 page.
Torbergsen,Hans-Emil Bensnes, "Application and Design of Passive Inflow Control Devices on the Eni Goliat Oil Producer Wells," Oct. 12, 2012, 138 pages, University of Stavanger, Faculty of Science and Technology.
Weatherford, "Maximizing Well Recovery by Creating Even Flow Distribution in Horizontal and Deviated Openhole Completions," obtained from www.weatherford.com, (c) 2005-2009, 4 pages.
Weatherford, "Conventional Well Screens," obtained from www.weatherford.com, (c) 2004-2009, pp. 1-15.
Weatherford, "Intermittent Production Now Flowing Steady with FloReg Inflow Control Devices," obtained from www.weatherford.com, (c) 2007-2008, 1 page.
Weatherford, "Well Screen Technologies," obtained from www.weatherford.com, (c) 2008, 12 pages.
Int'l Search Report in corresponding PCT Appl. PCT/US2016/060973, dated Jan. 13, 2017, 12-pgs.

* cited by examiner

INFLOW CONTROL DEVICE HAVING EXTERNALLY CONFIGURABLE FLOW PORTS AND EROSION RESISTANT BAFFLES

CROSS-REFERENCE TO RELATED APPLICATIONS

This is a non-provisional of U.S. Provisional Appl. 62/252,660, filed 9 Nov. 2015, which is incorporated herein by reference.

BACKGROUND OF THE DISCLOSURE

In unconsolidated formations, horizontal and deviated wells are normally completed with completion systems having integrated sand screens. To control the flow of produced fluids, the sand screens may use inflow control devices (ICD)—one example of which is disclosed in U.S. Pat. No. 5,435,393 to Brekke et al. Other examples of inflow control devices are also available, including the FloReg ICD available from Weatherford International, the Equalizer® ICD available from Baker Hughes, ResFlow ICD available from Schlumberger, and the EquiFlow® ICD available from Halliburton. (EQUALIZER is a registered trademark of Baker Hughes Incorporated, and EQUIFLOW is a registered trademark of Halliburton Energy Services, Inc.)

For example, a completion system 10 in FIG. 1 has completion screen joints 50 deployed on a completion string 14 in a borehole 12. Typically, these screen joints 50 are used for horizontal and deviated boreholes passing in an unconsolidated formation as noted above, and packers 16 or other isolation elements can be used between the various joints 50. During production, fluid produced from the borehole 12 directs through the screen joints 50 and up the completion string 14 to the surface rig 18. The screen joints 50 keep out fines and other particulates in the produced fluid. In this way, the screen joints 50 can mitigate damage to components, mud caking in the completion system 10, and other problems associated with fines and particulate present in the produced fluid.

Turning to FIGS. 2A-2C, the prior art completion screen joint 50 is shown in a side view, a partial side cross-sectional view, and a detailed view. The screen joint 50 has a basepipe 52 with a sand control jacket 60 and an inflow control device 70 disposed thereon. The basepipe 52 defines a through-bore 55 and has a coupling crossover 56 at one end for connecting to another joint or the like. The other end 54 can connect to a crossover (not shown) of another joint on the completion string. Inside the through-bore 55, the basepipe 52 defines pipe ports 58 where the inflow control device 70 is disposed.

The joint 50 is deployed on a production string (14: FIG. 1) with the screen 60 typically mounted upstream of the inflow control device 70. Here, the inflow control device 70 is similar to the FloReg Inflow Control Device (ICD) available from Weatherford International. As best shown in FIG. 2C, the device 70 has an outer sleeve 72 disposed about the basepipe 52 at the location of the pipe ports 58. A first end-ring 74 seals to the basepipe 52 with a seal element 75, and a second end-ring 76 attaches to the end of the screen 60. Overall, the sleeve 72 defines an annular space around the basepipe 52 that communicates the pipe ports 58 with the sand control jacket 60. The second end-ring 76 has flow ports 80, which separate the sleeve's inner space 86 from the screen 60.

For its part, the sand control jacket 60 is disposed around the outside of the basepipe 52. As shown, the sand control jacket 60 can be a wire wrapped screen having rods or ribs 64 arranged longitudinally along the base pipe 52 with windings of wire 62 wrapped thereabout to form various slots. Fluid from the surrounding borehole annulus can pass through the annular gaps and travel between the sand control jacket 60 and the basepipe 52.

Internally, the inflow control device 70 has nozzles 82 disposed in flow ports 80. The nozzles 82 restrict the flow of screened fluid from the screen jacket 60 into the device's inner space 86 and produce a pressure drop in the fluid. For example, the inflow control device 70 can have ten nozzles 82. Operators set a number of these nozzles 82 open at the surface to configure the device 70 for use downhole in a given implementation. In this way, the device 70 can produce a configurable pressure drop along the screen jacket 60 depending on the number of open nozzles 82.

To configure the device 70, pins 84 can be selectively placed in the passages of the nozzles 82 to close them off. The pins 84 are typically hammered in place with a tight interference fit and are removed by gripping the pin 84 with a vice grip and then hammering on the vice grip to force the pin 84 out of the nozzle 82. These operations need to be performed off rig beforehand so that valuable rig time is not used up. Thus, operators must predetermine how the inflow control devices 70 are to be preconfigured and deployed downhole before setting up the components for the rig.

When the joints 50 are used in a horizontal or deviated borehole of a well as shown in FIG. 1, the inflow control devices 70 are configured to produce particular pressure drops to help evenly distribute the flow along the completion string 14 and prevent coning of water in the heel section. Overall, the devices 70 choke production to create an even-flowing pressure-drop profile along the length of the horizontal or deviated section of the borehole 12.

Although the inflow control device 70 of the prior art is effective, it is desirable to be able to configure the pressure drop for a borehole accurately to meet the needs of a given installation and to be able to easily configure the pressure drop as needed. Moreover, flow passing through an inflow control device can reach high velocities as the flow exits internal ports. The high velocity flow may tend to damage components. For example, the high velocity flow can stress the surface of the basepipe in the inflow control device and can encourage corrosion.

The subject matter of the present disclosure is, therefore, directed to overcoming, or at least reducing the effects of, one or more of the problems set forth above.

SUMMARY OF THE DISCLOSURE

According to the present disclosure, a flow control apparatus for a borehole comprises a basepipe, a screen, a sleeve, and at least one baffle. The basepipe has a bore for conveying fluid and defines at least one opening for communicating fluid into the bore. The screen is disposed on the basepipe and screens fluid from outside the basepipe for eventual passage into the bore of the basepipe via the at least one opening. The sleeve is disposed on the basepipe adjacent the screen to control the flow of the screened fluid. The sleeve has at least one flow passage for communicating the fluid from the screen to the at least one opening in the basepipe. A shelf of the sleeve extends downstream from the at least one flow passage and covers at least a portion of the basepipe upstream from the at least one opening. The at least one baffle is disposed on the shelf of the sleeve downstream from the at least one flow passage and upstream from the at least one opening. The at least one baffle changes a direction of the flow exiting from the at least one flow passage.

The at least one baffle can be at least partially composed of an erosion-resistant material. For example, the at least one baffle can have a shield affixed thereto with the shield being composed of the erosion-resistant material. The at least one baffle can comprise a plurality of rib segments disposed on the shelf of the sleeve in an alternating pattern relative to one another and the at least one flow passage.

In one arrangement, the sleeve defines at least one external opening exposed externally on the sleeve and communicating with the at least one flow passage. At least one valve is disposed in the at least one external opening in the sleeve and is interposed in the at least one flow passage of the sleeve. The interposed valve is externally configurable to selectively control flow of the fluid from the screen through the at least one flow passage to the at least one opening defined in the basepipe. For example, the valve can be externally configurable between first and second states. Thus, the valve in the first state can permit fluid communication to the at least one opening, while the valve in the second state can prevent fluid communication to the at least one opening.

The interposed valve can comprise a nozzle orifice restricting the flow of the fluid in the first state of the valve through the at least one flow passage. This nozzle orifice can produce a pressure drop in the flow as desired.

In one particular example, the interposed valve can comprise a ball valve having an orifice defined therein and being rotatable relative to the at least one flow passage. The rotation of the ball valve is externally accessible on the exterior of the sleeve and changes fluid communication through the at least one flow passage.

On its own, the at least one flow passage can comprise a nozzle disposed therein for creating a pressure drop. Also, for one arrangement, the nozzle can be selectively configurable from an open state without a pin disposed in the nozzle and a closed state with the pin disposed in the nozzle.

In another arrangement, the sleeve defines at least one external opening communicating with the at least one flow passage. At least one set of first and second inserts can be selectively inserted in the at least one external opening in the sleeve relative to the at least one flow passage. For example, the first insert can selectively prevent the flow of the fluid from the screen through the at least one flow passage to the at least one opening defined in the basepipe, while the second insert can selectively prevent the flow of the fluid from the screen through the at least one flow passage to the at least one opening defined in the basepipe. The at least one set of the first and second inserts can each be selectively affixable in the at least one external opening.

Regarding the construction of the sleeve, one arrangement of the sleeve comprises an intermediate body, a first housing portion, and a second housing portion. The intermediate body has the at least one flow passage and the shelf of the sleeve. The first housing portion is disposed about the basepipe between an end-ring of the screen and the intermediate body. The first housing portion encloses a first chamber for passage of the fluid to the at least one flow passage. The second housing portion is disposed about the basepipe from the intermediate body and encloses a second chamber for passage of the fluid from the at least one flow passage to the at least one opening in the basepipe. The second housing portion can enclose the at least one baffle disposed on the shelf of the sleeve.

Regarding the construction of the sleeve, another arrangement of the sleeve comprises a body and a housing portion. The body has the at least one flow passage and has a first end disposed against an end-ring of the screen so the body receives the fluid from the screen permitted to flow past the end-ring. For its part, the housing portion of the sleeve is disposed about the basepipe from a second of the body and encloses a chamber for passage of the fluid from the at least one flow passage to the at least one opening in the basepipe. The housing portion can include an integral end-ring that attaches to the basepipe, or a separate end-ring arrangement may be used.

Regarding the construction of the sleeve, yet another arrangement of the sleeve comprises a body, a first housing portion, and a second housing portion. The body has the at least one flow passage and has the shelf. The first housing portion is disposed about the basepipe between an end-ring of the screen to an intermediate portion of the body. The first housing encloses communication of the fluid from the at least one screen. The second housing portion is disposed about the basepipe from the intermediate portion of the body and encloses communication of the fluid to the at least one opening in the basepipe. The second housing portion can include an integral end-ring that attaches to the basepipe, or a separate end-ring arrangement may be used. For this arrangement, the housing portions can cover the body of the sleeve and can form part of the flow passage of the sleeve.

According to the present disclosure, a flow control apparatus for a borehole comprises a basepipe, a filter, and at least one flow device. The basepipe has a bore for conveying fluid and defines at least one opening for communicating fluid into the bore. The filter is disposed on the basepipe and filters fluid from the borehole. The at least one flow device is disposed on the basepipe and communicates the fluid from the filter to the at least one opening defined in the basepipe.

The at least one flow device comprises a first housing portion, a body, and a second housing portion. The first housing portion encloses a first chamber about the basepipe and receives the fluid from the filter into the first chamber. The body is disposed on the basepipe and defines at least one flow passage communicating with the first chamber. The body has at least one baffle disposed downstream of the at least one flow passage and arranged to change a direction of the flow exiting the at least one flow passage. The second housing portion encloses a second chamber about the basepipe. The second housing portion receives the fluid from the body and communicates with the at least one opening in the basepipe.

The flow device can comprise at least one flow restriction interposed in the at least one flow passage of the body between the first and second chambers and controlling the flow of the fluid therebetween. At least a portion of the at least one flow restriction can be accessible on the exterior of the apparatus so that the at least one flow restriction can be externally configurable and selectively controlling flow of the fluid. For example, the at least one flow restriction can be externally configurable between first and second states. Therefore, the at least one flow restriction in the first state can permit fluid communication to the at least one opening, while the at least one flow restriction in the second state can prevent fluid communication to the at least one opening.

In one arrangement, the at least one flow restriction comprises a valve being externally accessible on the exterior of the apparatus and being selectively configurable between an open state and a closed state relative to the at least one flow passage. The valve can comprise a ball valve having an orifice defined therein and being rotatable relative to the flow port so that the rotation of the ball valve is externally accessible on the exterior of the apparatus and changes fluid communication through the flow port.

The first housing portion can have a first end-ring and a first sleeve. The first end ring is affixed to the basepipe adjacent the filter, and the first sleeve forms the first chamber. The first sleeve has a first end affixed to the first end ring and has a second end affixed to the body. The second housing portion can have a second end-ring and a second sleeve. The second end-ring is affixed to the basepipe adjacent the at least one opening, and the second sleeve forms the second chamber. The second sleeve has a first end affixed to the second end ring and has a second end affixed to the body. The second end ring and the second sleeve at the first end can be integral with one another.

The at least one baffle can comprise one or more walls disposed partially about a circumference of the body. The one or more walls can be a set of the one or more walls separated along a length of the body, and a portion of the second housing portion can enclose the one or more walls. A shield can be affixed to a portion of at least one baffle and can be composed of a material different than the at least one baffle.

According to the present disclosure, a flow control method for a borehole comprises: selectively configuring one or more flow devices disposed in one or more flow passages of a sleeve on a basepipe; deploying the basepipe in the borehole; receiving fluid in the sleeve from outside the basepipe; controlling flow of the received fluid through the one or more flow passages to one or more internal openings in the basepipe using the one or more flow devices; and changing a direction of the flow exiting from the one or more flow passages to the one or more internal openings of the basepipe by using at least one baffle disposed on a shelf of the sleeve extending downstream from the one or more flow passages and covering portion of the basepipe upstream of the one or more internal openings.

Selectively configuring the one or more flow devices can comprise selectively permitting or preventing fluid communication to the one or more internal openings through the one or more flow devices; selectively opening or closing fluid communication through the one or more flow devices by externally opening or closing an internal valve of the one or more flow devices; or selectively opening or closing fluid communication through the one or more flow devices by selectively inserting one of a set of inserts in an external opening of the housing on the basepipe.

The foregoing summary is not intended to summarize each potential embodiment or every aspect of the present disclosure.

DETAILED DESCRIPTION OF THE DISCLOSURE

A completion screen joint or flow control apparatus 100 of the present disclosure shown in FIGS. 3A-3D can overcome the limitations of the prior art completion screen joint. According to one aspect, the apparatus 100 enables operators to externally configure and control the inflow of fluid by using the teachings disclosed in U.S. Pub. 2013/0319664, which is incorporated herein by reference in its entirety. According to another aspect, the apparatus 100 reduces shear stress due to high velocity fluid exiting flow ports in the apparatus 100. As noted, the high velocity fluid passes over the material of the basepipe and other internal components and can produce shear stresses in the material that encourage corrosion. For this reason, features of the apparatus 100 (namely one or more baffles discussed below) are used to slow down the fluid exiting the flow ports by comingling the exiting fluid with lower velocity fluid already in a chamber in the apparatus 100.

Figure 1:
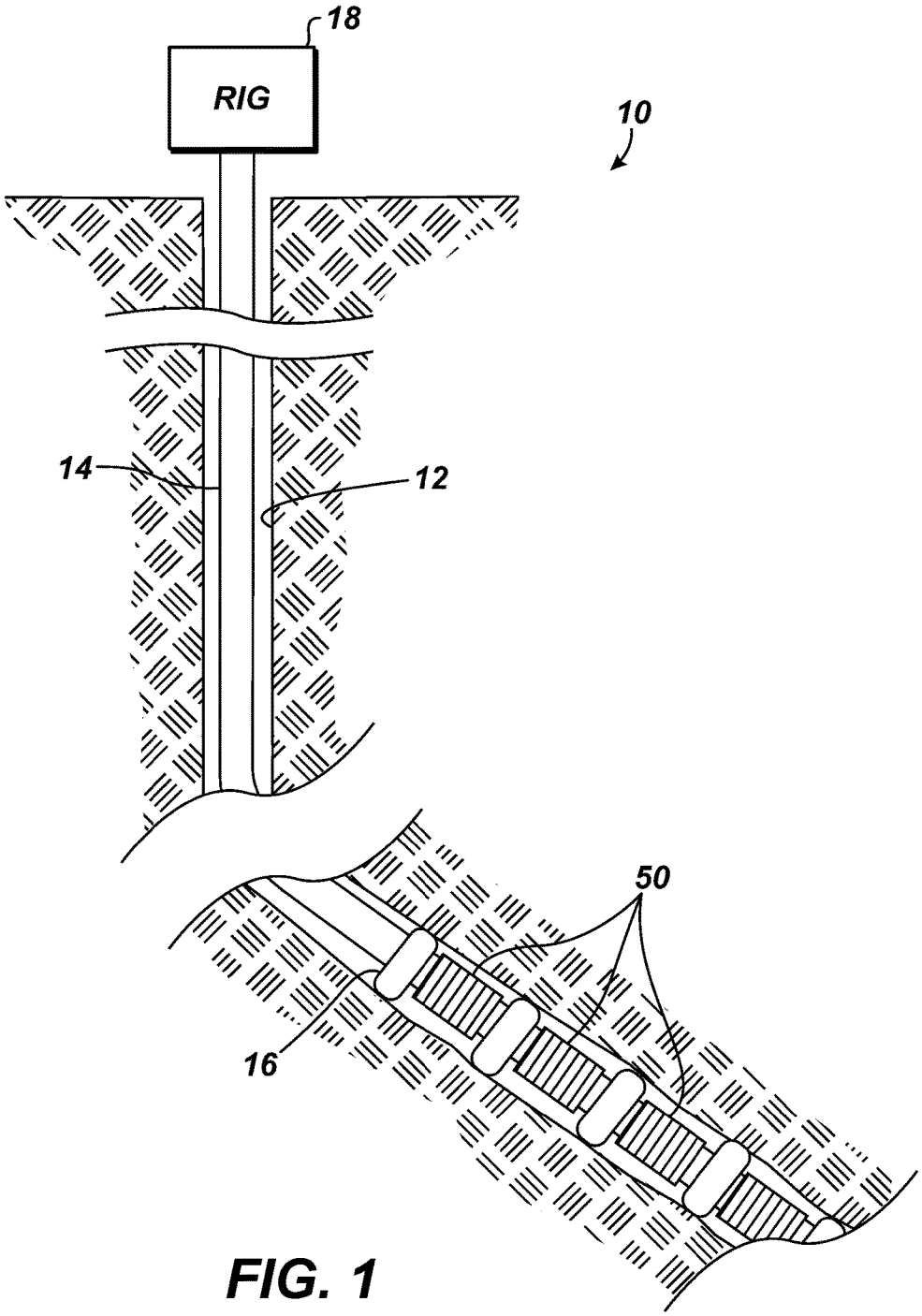
FIG. 1 (Prior Art)
FIG. 1 illustrates a completion system having completion screen joints deployed in a borehole.
Figure 2A:
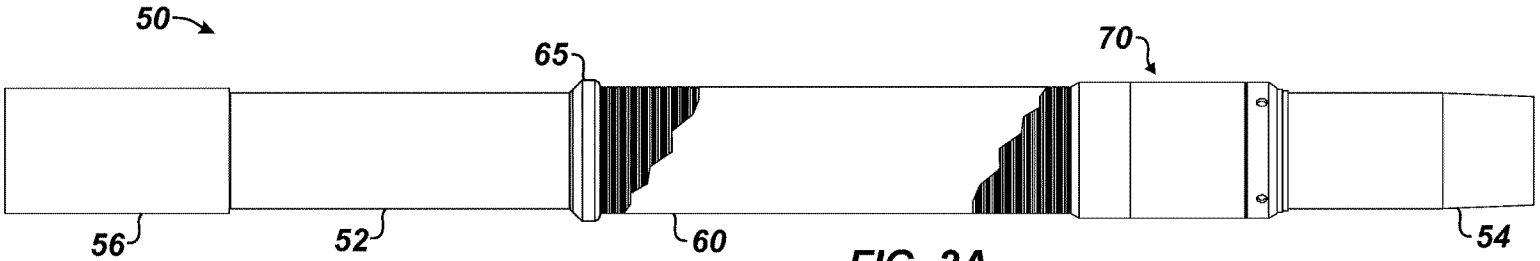
FIG. 2A (Prior Art)
FIG. 2A illustrates a completion screen joint according to the prior art.
Figure 2B:
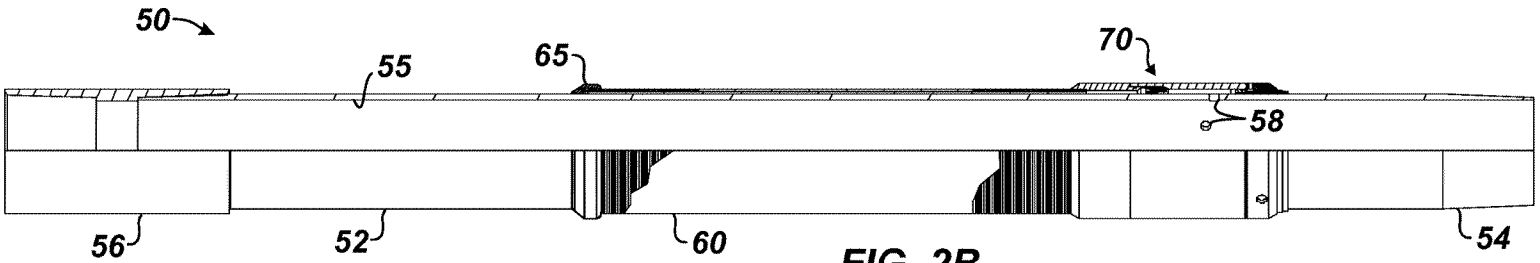
FIG. 2B (Prior Art)
FIG. 2B illustrates the prior art completion screen joint in partial cross-section.
Figure 2C:
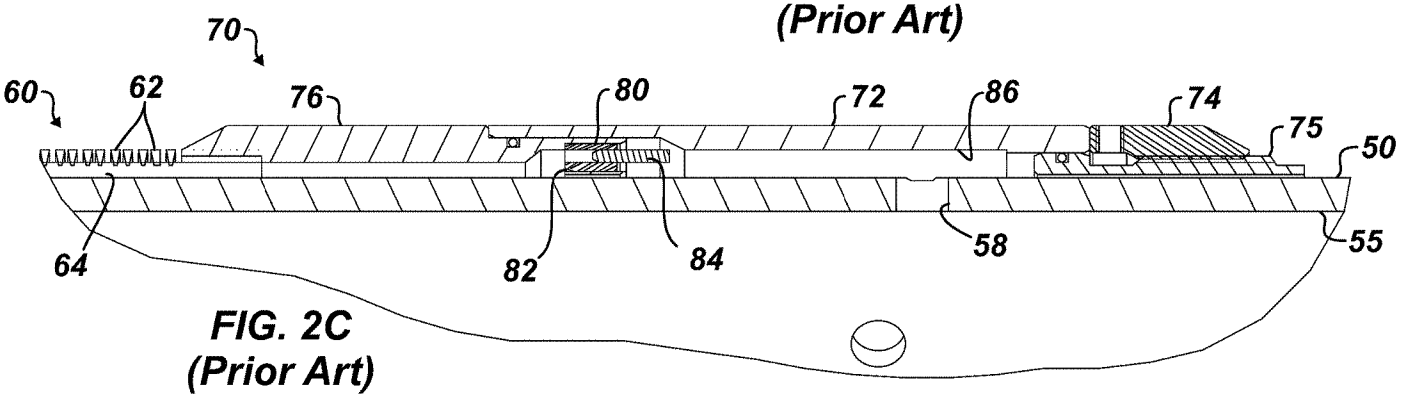
FIG. 2C (Prior Art)
FIG. 2C illustrates a detail on an inflow control device for the prior art completion screen joint.
Figure 3A:
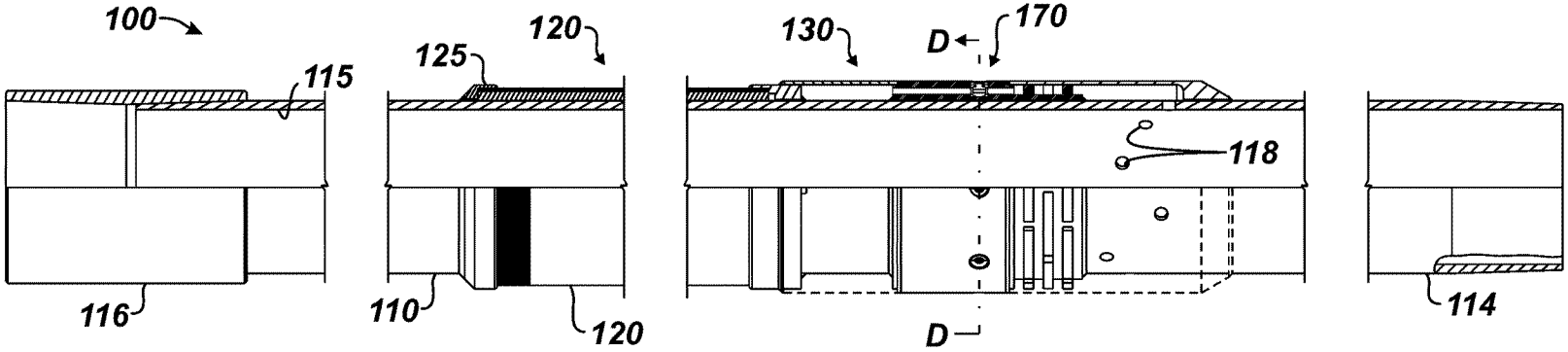
FIG. 3A illustrates a completion screen joint having an inflow control device according to the present disclosure.
Figure 3B:
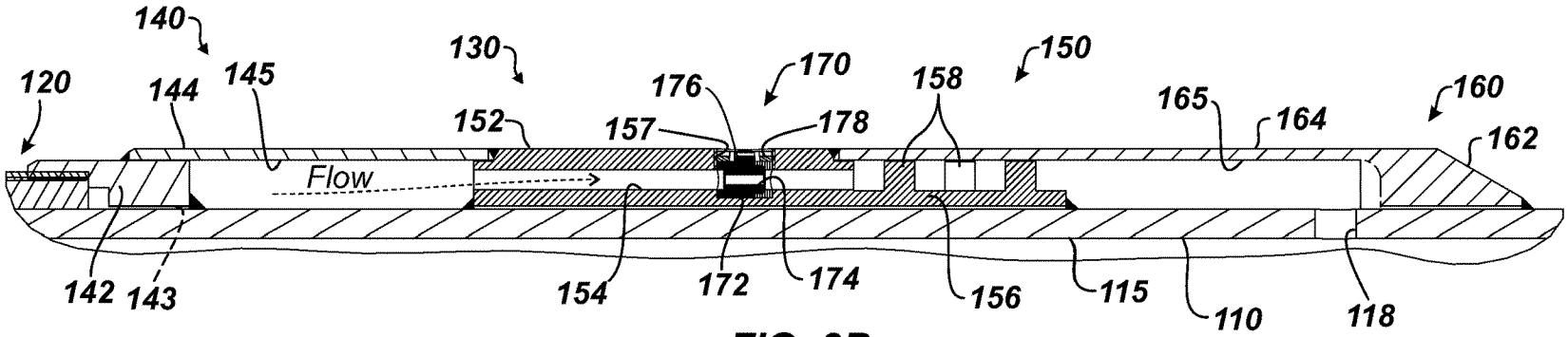
FIG. 3B illustrates the disclosed completion screen joint in partial cross-section.
Figure 3C:
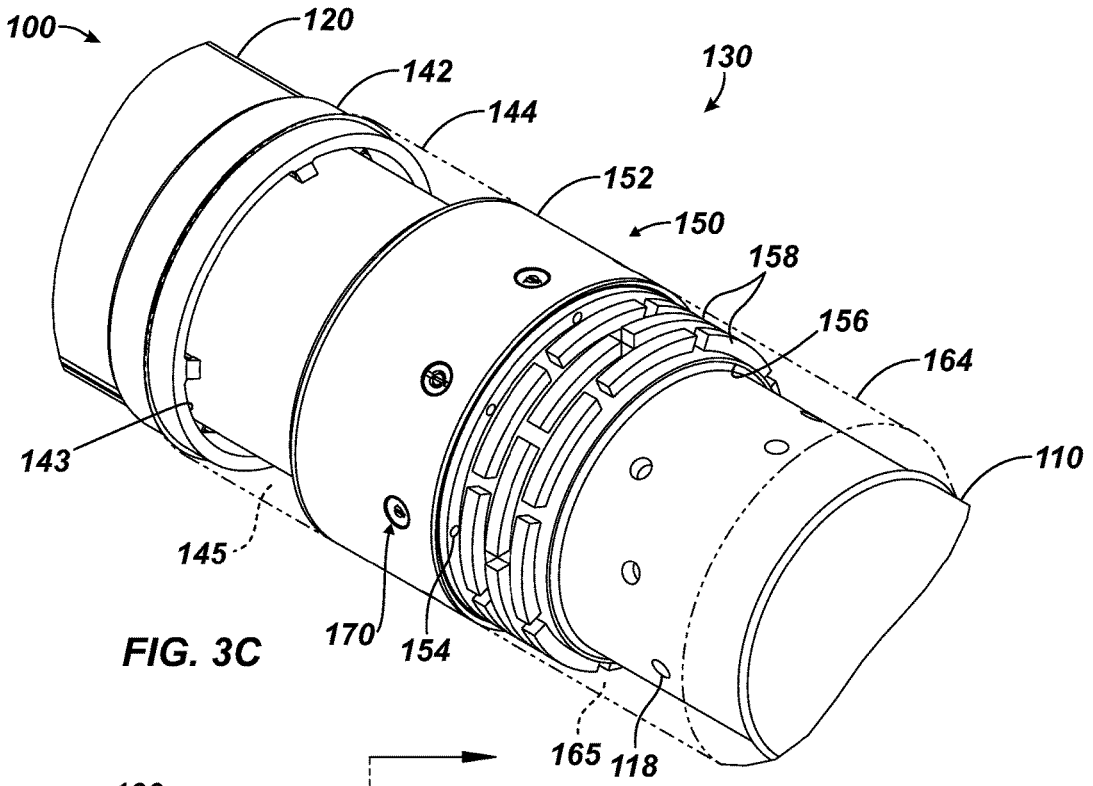
FIG. 3C illustrates a perspective view of a portion of the disclosed completion screen joint.
Figure 3D:
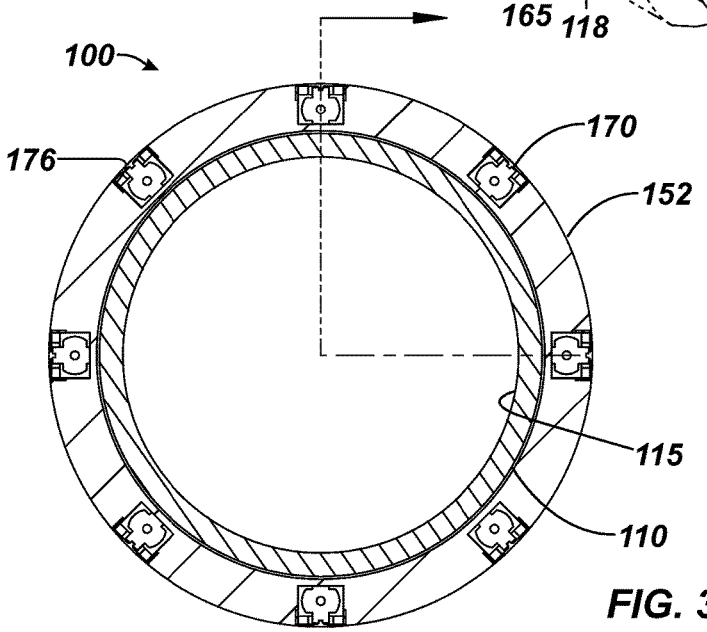
FIG. 3D illustrates an end-section of the disclosed completion screen joint taken along line E-E of FIG. 3A.

Turning to the drawings, the joint 100 is shown in a side view in FIG. 3A, a partial cross-sectional view in FIG. 3B, a partial perspective view in FIG. 3C, and an end-sectional view in FIG. 3D. This completion screen joint 100 can be used in a completion system, such as described above with reference to FIG. 1, so that the details are not repeated here.

The completion screen joint 100 includes a basepipe 110, a sand control jacket or screen 120, and an inflow control device 130. The inflow control device 130 is mounted on the basepipe 110 and communicates with the sand control jacket 120. The basepipe 110 defines a through-bore 115 for conveying produced fluid and defines at least one flow opening 118 for conducting produced fluid from outside the basepipe 110 into the bore 115. To connect the joint 100 to other components of a completion system, the basepipe 110 has a coupling crossover 116 at one end, while the other end 114 can connect to a crossover (not shown) of another basepipe.

For its part, the sand control jacket 120 disposed around the outside of the basepipe 110 screens fluid from outside the basepipe 110. The jacket 120 can use any of the various types of screen or filter assemblies known and used in the art so that the flow characteristics and the screening capabilities of the joint 100 can be selectively configured for a particular implementation. In general, the jacket 120 can comprise one or more layers, including wire wrappings, porous metal fiber, sintered laminate, pre-packed media, etc.

As shown in FIG. 3A, for example, the jacket 120 can be a wire-wrapped screen having rods or ribs arranged longitudinally along the basepipe 110 with windings of wire wrapped thereabout. The wire forms various slots for screening produced fluid, and the longitudinal ribs create channels that operate as a drainage layer. Other types of screen assemblies can be used for the jacket 120, including metal mesh screens, pre-packed screens, protective shell screens, expandable sand screens, or screens of other construction.

During production, fluid from the surrounding borehole annulus can pass into the sand control jacket 120 and can pass along the annular gap between the sand control jacket 120 and the basepipe 110. An outside edge of the screen jacket 120 has a closed end-ring 125 (FIG. 3A), preventing screened fluid from passing. Instead, the screened fluid in the gap of the jacket 120 and the basepipe 110 passes to the inflow control device 130, which is disposed on the basepipe 110 at the location of the flow openings 118.

The inflow control device 130 includes at least one valve 170 for at least one flow passage 154 and includes a shelf 156 and at least one baffle 158. The inflow control device 130 is disposed on the basepipe 110 and communicates the fluid from the screen jacket 120 through at least one flow passage 154 to the at least one opening 118 defined in the basepipe 118.

To facilitate construction, the inflow control device 130 can be composed of several components, including a first housing portion 140, an intermediate body or sleeve 150, and a second housing portion 160. In particular, the first housing portion 140 has a first end-ring 142 disposed on the basepipe 110 adjacent the screen jacket 120. The end-ring 142 abuts the inside edge of the screen jacket 120 and defines a fluid passage 143 in fluid communication with the fluid from the screen jacket 120.

Being open, the end-ring 142 has internal channels, slots, or passages 143 that can fit partially over the inside edges of the jacket 120. During use, these passages 143 allow fluid screened by the jacket 120 to communicate through the open end-ring 142 to a housing chamber 145 enclosed by a first housing 144, such as a cylindrical sleeve. As also shown in the exposed perspective of FIG. 3C, walls or dividers between the passages 143 support the open end-ring 142 on the basepipe 110 and can be attached to the pipe's outside surface during manufacture. It will be appreciated that the open end-ring 142 can be configured in other ways with openings to allow fluid flow therethrough.

The intermediate sleeve 150 includes an intermediate ring or body 152 disposed on the basepipe 110 adjacent the first end-ring 142 and the first housing 144. The intermediate ring 152 defines the at least one flow passage 154 and has the at least one valve 170 and the at least one baffle 158 disposed thereon. The first housing 144 is disposed between the first end-ring 142 and the intermediate ring 152 and encloses the first chamber 145 with the basepipe 110 for passage of the fluid to the at least one flow passage 154. As shown, the first housing 144 can be a separate component affixed to the first end-ring 142 and the intermediate ring 152 by welding or the like.

The second housing portion 160 includes a second end-ring or body 162 disposed on the basepipe 110 adjacent the intermediate ring 152 to prevent further passage of the flow beyond the at least one opening 118 in the basepipe 100. A second housing or sleeve 164 is disposed between the intermediate ring 152 and the second end-ring 162 and encloses a second chamber 165 with the basepipe 110 for passage of the fluid to the openings 118. As shown, the second housing 164 can be an integral component to the second end-ring 162 and affixed to the intermediate ring 152 by welding or the like.

For this assembly, the housings 144 and 164 affix to the end rings 142 and 162 and the intermediate ring 150, and the end-rings 142 and 162 and the intermediate ring 150 affix to the basepipe 110. In this way, the inflow control device 130 can be permanently affixed to the basepipe 110, and no O-rings or other seal elements are needed for the flow device's components 140, 150, and 160. This form of construction can improve the longevity of the flow device 130 when deployed downhole.

The second housing 164 actually encloses the at least one baffle 158 on the intermediate ring 152. In particular, the intermediate ring 152 of the flow device 130 has a sleeve portion, collar, or shelf 156 extending downstream from the flow passage 154 and passing adjacent a portion of the basepipe 110. The at least one baffle 158 is disposed on the shelf 156 and is enclosed by portion of the housing 164.

FIGS. 3C-3D reveal additional details of the intermediate sleeve 150 and show how flow of screened fluid (i.e., inflow) can reach the pipe's openings 118. Several flow passages 154 are defined in the intermediate ring 152 and communicate with one or more inner chambers (165) of the second housing portion 160. In turn, the one or more inner chambers 165 communicate with the pipe's openings 118.

During operation, for example, screened fluid from the screen jacket 120 can commingle in the device's first chamber 145. In turn, each of the flow passages 154 can communicate the commingled screened fluid from the first chamber 145 to the one or more inner chambers 165, which communicate the fluid with the basepipe's openings 118.

To configure how screened fluid can enter the basepipe 110 through the openings 118, the intermediate sleeve 150 has the at least one valve 170 disposed therein. (Although all of the flow passages 154 have a valve 170, only one or more may have a valve 170 while other flow passages 154 may have permanently open nozzles or the like.) In fact, each of or at least more than one of the flow passages 154 in the intermediate ring 152 can have such a valve 170. Together or separately, the flow passages 154 and the valves 170 restrict flow of screened fluid and produce a pressure drop across in the flow to achieve the purposes discussed herein.

The valve 170 is externally configurable between first and second states. In the first state, the valve 170 permits fluid communication through the flow passage 154 to the opening 118. In the second state, the valve 170 prevents fluid communication through the flow passage 154 to the opening 118. Intermediate states may also be used to throttle the fluid communication. In general, the valve 170 can include a flow port, a constricted orifice, a nozzle, a tube, a syphon, or other such flow feature that controls and restricts fluid flow. Here, the valve 170 has a restriction, orifice, or nozzle 172 that restricts the flow of the fluid through the flow passage 154 and produces a pressure drop in the flow of the fluid.

Details of one of the valves 170, the at least one baffle 158, etc. are shown in FIG. 3C. The flow passages 154 restrict passage of the screened fluid from the housing chamber 145 to the one or more inner chambers 165 associated with the flow passages 154. This inner chamber 165 is essentially a pocket defined in the inside surface of the second housing portion 160 and allows flow from the flow passages 154 to communicate with the pipe's openings 118. The pocket chamber 165 may or may not communicate with one or more of the flow passages 154. Other configurations are also possible.

Depending on the configuration of the valves 170 and the flow characteristics, flow passing through the flow passages 154 to the second chamber 165 before passing through the openings 118 can reach certain high flow rates that increase the chances of erosion and/or corrosion. For example, the basepipe 110 can be composed of a suitable material, such as 13Cr. In these instances, the basepipe 110 can be exposed to high flow rates during use, and high fluid shear values at the boundary of 13Cr material and the fluid can induce corrosion on the basepipe 110. The advised maximum wall shear stress may be 40 Pa.

To reduce the chances of induced erosion and/or corrosion, the flow device 130 has an integral baffle arrangement with staggered baffles 158 introduced downstream of the flow passages 154 and upstream of the openings 118 and exposed basepipe 110. As the fluid exits the flow passages 154, the flow impinges on the baffles 158. This causes an immediate change in direction of the fluid that prevents the fluid from making contact with the 13Cr material of the basepipe 110 near the openings 118 while at high speed. The direction change affords the high speed fluid the opportunity to comingle with slow speed fluid present in the chamber 165. This is preferably achieved to an extent that, when the fluid eventually comes in contact with the 13Cr material of the basepipe 110, the fluid would be travelling at such a slow speed that the wall shear experienced is significantly lower than the maximum (e.g., 40 Pa or so).

Additionally, the shelf 156 of the intermediate ring 152 is disposed upstream of (and covers) the exposed portion of the basepipe 110 having the opening 118. As the fluid exits the flow passages 154, the shelf 156 can prevent exiting fluid from directly interacting with the basepipe's material as the fluid exits.

As depicted, the intermediate ring 152 of the flow device 130 can be integrally machined with the arrangement of baffles 158. As such, the entire body of the intermediate ring 152 can be composed of an erosion-resistant material. For example, the ring 152 can be composed of a more erosion-resistant material than the basepipe 110 or can even be composed of 13Cr material. In one arrangement, such as discussed later, surface treatments, inserts, or shields (not shown) can be affixed, formed, fused, adhered, brazed or the like onto the face of the baffles 158 to provide particular erosion resistance.

Again, the at least one baffle 158 includes several baffles disposed on the shelf 156 of the intermediate ring 152. These baffles 158 are downstream from the valves 170 and flow passages 154 and are upstream of a portion of the basepipe 110 adjacent the opening 118. In the particular arrangement shown, the baffles 158 are formed as a plurality of rib segments disposed at least partially about the circumference of the shelf 156. The rib segments of the baffles 158 extend from the shelf 156 and are disposed in an alternating pattern relative to one another and the flow passages 154. The shelf 156 and the baffles 158 reduce erosion from the flow of fluid exiting from the flow passages 154 and any jetting that may occur. The baffles 158 can be at least partially composed of an erosion-resistant material. Likewise, the shelf 156 can be at least partially composed of an erosion-resistant material. As the flow exits the flow passages 154, the baffles 158 change the direction of the flow before it can reach the openings 118 and before it can interact with any exposed area of the basepipe 110 in the chamber 165.

As noted above, the valves 170 are accessible from an exterior of the flow device 130. In this way, the valves 170 can be externally configurable to selectively control flow of the fluid from the screen jacket 120, through the flow passages 154, and to the openings 118 defined in the basepipe 110.

In particular, the adjustable valves 170 can be accessed via an external opening 157 in the intermediate ring 152 to open or close passage of fluid through the flow passages 154. As shown in FIGS. 3A-3B and 3D, the valves 170 can be a ball-type valve having a ball body 172 that fits down in the external opening 157 of the intermediate ring 152 and interposes between the ends of the flow passage 154. Preferably, the valve 170 is composed of an erosion-resistant material, such as tungsten carbide, to prevent flow-induced erosion. Seal elements can engage around the ball body 172 of the valve 170 to seal fluid flow around it, and a spindle of the valve 170 can extend beyond a retainer 178 threaded or otherwise affixed in the external opening 157 of the intermediate ring 152 to hold the valve 170. The seal elements can be composed of polymer or other suitable material.

The exposed spindle can be accessed with a tool (e.g., flat head screwdriver, Allen wrench, or the like) externally on the intermediate ring 152 so the valve 170 can be turned open or closed without needing to open or remove portions of the housing (140, 150, 160). This turning either orients an orifice 174 in the valve 170 with the flow passage 154 or not. In general, quarter turns may be all that is needed to fully open and close the valves 170. Partial turns may be used to open and close the valves 170 in intermediate states for partially restricting flow if desired.

When the valve 170 is fully closed and the orifice 174 does not communicate with the flow passage 154, fluid flow does not pass through the flow passage 154 to the pipe's opening 118. When the valve 170 is (fully or at least partially) open, the flow through the flow passage 154 passes through the orifice 174 to the pipe's opening 118 so the flow can enter the pipe's bore 115. The orifice 174 in the open valve 170 can act as a flow nozzle to restrict the flow in addition to any flow restriction provided by the flow passage 154 itself. Thus, the internal diameter of the orifice 174 can be sized as needed for the particular fluids to be encountered and the pressure drop to be produced.

To configure the inflow control device 130 of FIGS. 3A-3D, a set number of valves 170 are opened by turning a desired number of the valves 170 to the open position. Other valves 170 are turned to the closed position. By configuring the number of open valves 170, operators can configure the inflow control device 130 to produce a particular pressure drop needed in a given implementation.

As an example, the inflow control device 130 can have several (e.g., ten) valves 170, although they all may not be open during a given deployment. In this way, operators can configure flow through the inflow control device 130 to the basepipe's openings 118 through any of one to ten open valves 170 so the inflow control device 130 allows for less inflow and can produce a configurable pressure drop along the screen jacket 120. If one valve 170 is open, the inflow control device 130 can produce an increasing pressure drop across the device 130 with an increasing flow rate. The more valves 170 that are opened, the more inflow that is possible, but the less markedly will the device 130 exhibit an increase in pressure drop relative to an increase in flow rate.

Further details related to the valves 170 and their use on the inflow control device 130 are disclosed in the incorporated U.S. Pub. 2013/0319664.

In previous arrangements, the valves 170 have incorporated a flow restriction so that the orifice 174 acts as a nozzle to restrict fluid flow through the flow passage 154. As an alternative, the flow restriction or nozzle may be separate from the valve used to control flow through the flow passage 154.

In the arrangements described above, the valves 170 used ball-type valves that can rotate in external openings 157 in the intermediate ring 152 to open or close fluid flow through a flow passages 154. Other types of valves and closure mechanisms can be used, including, but not limited to, gate-type valves, butterfly-type valves, and pin or plug mechanisms, such as disclosed in incorporated U.S. Pub. 2013/0319664.

Figure 4:
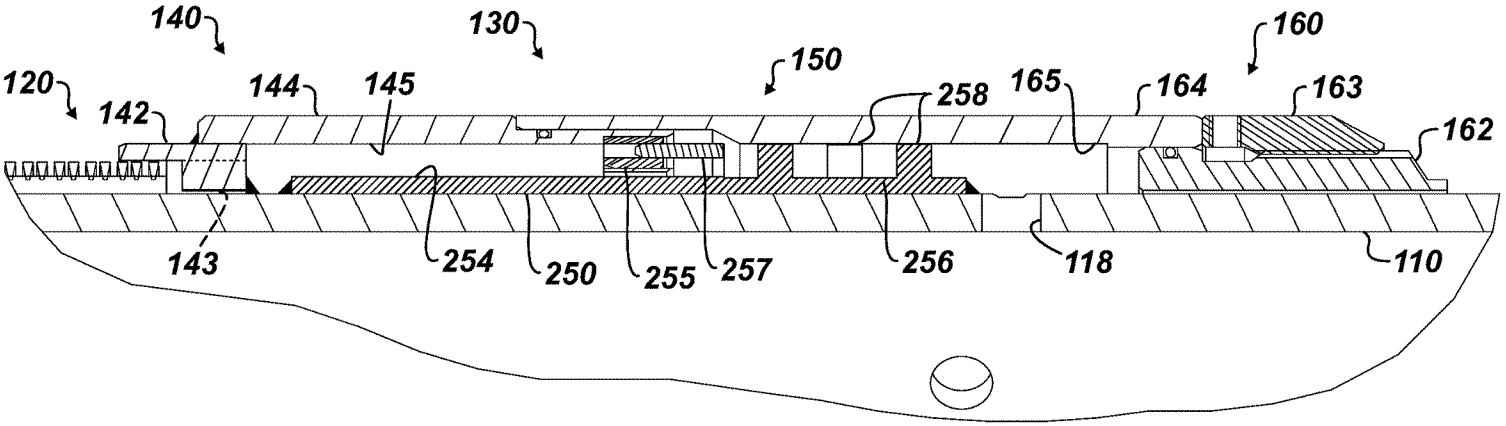
FIG. 4 illustrates a portion of completion screen joint having another inflow control device according to the present disclosure.

In contrast to previous embodiments, the joint 100 can use a conventional nozzle without externally configurable valves. For example, FIG. 4 illustrates a portion of completion screen joint 100 having another inflow control device 130 according to the present disclosure. (Many of the components of the joint 100 and the device 130 are similar to those described above so that their description is not repeated here.)

Again, the screen joint 100 includes a basepipe 110, a screen jacket 120, and an inflow control device 130. The basepipe 110 has a bore 115 for conveying fluid and defines at least one opening 118 for communicating fluid into the bore 115. The screen jacket 120 is disposed on the basepipe 110 and screens fluid from outside the basepipe 110.

Here, the inflow control device 130 includes a sleeve, collar, or shelf 250 (i.e., sleeve portion) and housing portions (140, 160). The sleeve portion 250 is disposed on the basepipe 110 and has at least one flow passage 154. The housing portions (140, 160) are disposed on the basepipe 110 about the sleeve portion 250 and encloses communication of the fluid from the screen jacket 120, through the flow passage 254, and to the opening 118 defined in the basepipe 110.

At least one baffle 258 is disposed on the sleeve portion 250 downstream from the flow passage 254 and upstream of a portion of the basepipe 110 adjacent the opening 118. As noted previously, the at least one baffle 258 can be at least partially composed of an erosion-resistant material and changes the direction of the flow exiting from the flow passage 254.

As shown here, the flow passage 254 includes a nozzle 255 disposed therein. The nozzle 255 is selectively configurable from an open state without a pin 257 disposed in the nozzle 255 and a closed state with the pin 257 disposed in the nozzle 255.

The housing portions (140, 160) include end-rings 142 and 162 and one or more housing sleeves 144, 164. In particular, a first end-ring 142 is disposed on the basepipe 110 adjacent the screen jacket 120 and defines a fluid passage 143 in fluid communication with the fluid from the screen jacket 120. A second end-ring 162 is disposed on the basepipe 110 adjacent the opening 118 and prevents further passage of the flow beyond the opening 118 in the basepipe 110. The housing sleeves 144 and 164 are disposed about the sleeve portion 250 between the first and second end-rings 142 and 162, meet at an intermediate portion, and enclose passage of the fluid from the screen jacket 120 to the opening 118. A lock ring 163 can be used to hold the second housing sleeve 164 in place, and the housing sleeves 144 and 164 can overlap and seal with one another.

Figure 5:
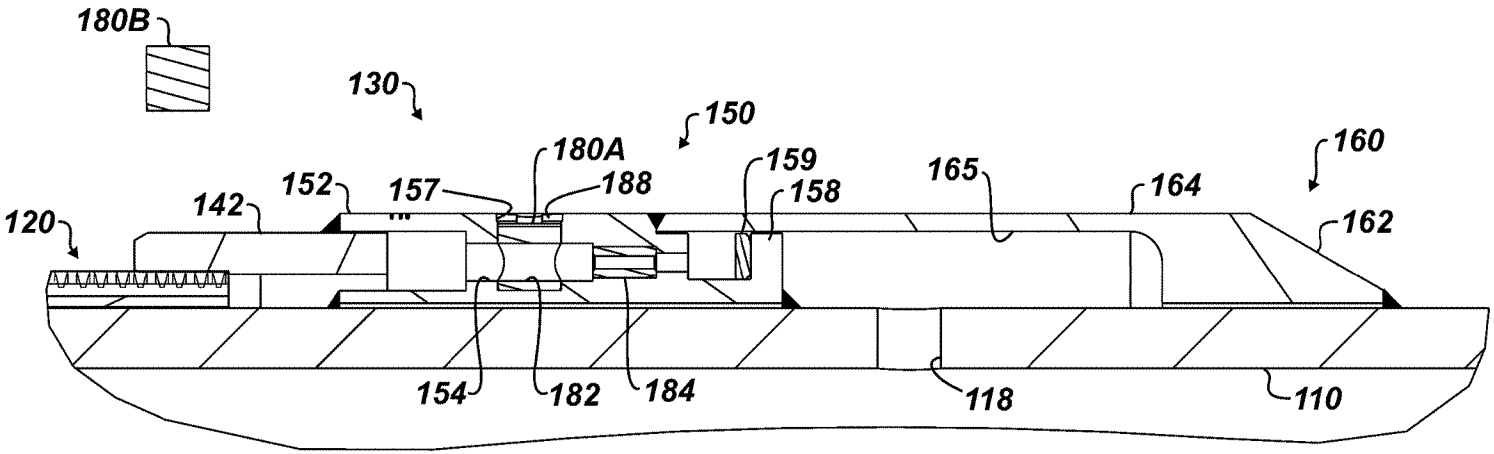
FIG. 5 illustrates a portion of a completion screen joint having yet another inflow control device according to the present disclosure.

As noted above, other closure mechanisms can be used in the inflow control device 130 of the present disclosure. For example, FIG. 5 illustrates another completion screen joint 100 having yet another inflow control device 130 according to the present disclosure in cross-section. (Many of the components of the joint 100 and the device 130 are similar to those described above so that their description is not repeated here.)

Here, the inflow control device 130 includes a sleeve 150 with an intermediate ring 152 disposed on the basepipe 110 and communicating the fluid from the screen jacket 120 through at least one flow passage 154 to the opening 118 defined in the basepipe 110. An end of the intermediate ring 152 directly abuts and attaches to an end-ring 142 of the screen 120. A housing portion 160 with end-ring 162 and housing sleeve 164 enclosing a chamber 165 attaches to the other end of the intermediate ring 152.

At least one baffle 158 is disposed on a shelf 156 of the ring 152 downstream from the flow passage 154 and upstream of the portion of the basepipe 110 adjacent the opening 118.

To configure flow, a set of first and second inserts 180A-B are selectively insertable from the exterior of the intermediate ring 152 relative to the flow passage 154. The first insert 180A has a passage 182, while the second insert 180B does not. When the first insert 180A is inserted in the cross-port 157 as shown in FIG. 5, the first insert 180A selectively allows the flow of the fluid from the screen jacket 120 through the flow passage 154 to the opening 118 defined in the basepipe 110. A separate nozzle 184 may be provided, although the flow passage 182 of the first insert 180A could include such a nozzle instead. When the second insert 180B is instead inserted in the cross-port 157, the second insert 180B selectively prevents the flow of the fluid through the flow passage 154.

The inserts 180A-B are selectively affixable in the cross-port 157 on the exterior of the intermediate ring 152. For example, the inserts 180A-B can thread into the external opening 157 and/or may be held by a spring clip 188 and sealed by sealing elements (not shown).

As shown here, the at least one baffle 158 includes a shield 159 of different material affixed to an interior wall of the baffle 158. This shield 159 is composed of an erosion resistant material, whereas the remainder of the baffle 158 may or may not be. For example, the shield 159 can be composed of Tungsten Carbide and can be attached, fused, adhered, brazed, or the like to the face of the baffle.

Any of the various embodiments of the baffles 158/258 disclosed herein can be similarly configured with such shields. Of course, any of the various embodiments of the baffles 158/258 can be integrally composed of the erosion resistant material.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In the implementations above, the inflow control devices 130 have used flow passages, nozzles, and/or valve mechanisms to control and restrict fluid communication to the pipe's openings 118 and create the desired pressure drop. Additional features can be used to control flow and create the pressure drop, including a constricted orifice, a tube, a syphon, or other such feature. For example, the inflow control device 130 can utilize convoluted channels or tortuous pathways to control and restrict fluid communication from the screen jacket 120 to the pipe's openings 118.

Any of the various components disclosed herein for one of the inflow control devices 130 can be substituted by any of the other components of the other inflow control devices 130. Additionally, any of the various components for one of the inflow control devices 130 can be used in combination with any of the other components of other inflow control devices 130 so that a hybrid arrangement can be used on the same inflow control device 130.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A flow control apparatus for a borehole, the apparatus comprising:

a basepipe having a bore for conveying fluid and defining at least one opening for communicating fluid into the bore;

a screen disposed on the basepipe and screening fluid from outside the basepipe;

a sleeve disposed on the basepipe adjacent the screen and enclosing at least one inner chamber in communication with the at least one opening in the basepipe, the sleeve having at least one flow passage for communicating the fluid in a longitudinal direction from the screen toward the at least one inner chamber in fluid communication with the at least one opening in the basepipe, a shelf of the sleeve extending in the longitudinal direction downstream from the at least one flow passage and covering at least a portion of the basepipe upstream from the at least one opening; and at least one baffle disposed on the shelf of the sleeve downstream from the at least one flow passage and upstream from the at least one opening, the at least one baffle changing the flow exiting from the at least one flow passage from the longitudinal direction to a lateral direction before allowing the flow to enter the at least one inner chamber in fluid communication with the at least one opening.

2. The apparatus of claim 1, wherein the at least one baffle is at least partially composed of an erosion-resistant material.

3. The apparatus of claim 2, wherein the at least one baffle comprises a shield affixed thereto, the shield being composed of the erosion-resistant material.

4. The apparatus of claim 1, wherein the at least one baffle comprises a plurality of rib segments disposed on the shelf of the sleeve in an alternating pattern relative to one another and the at least one flow passage.

5. The apparatus of claim 1, wherein the sleeve defines at least one external opening communicating with the at least one flow passage; and wherein the apparatus further comprises:

at least one valve disposed in the at least one external opening in the sleeve, the at least one valve interposed in the at least one flow passage of the sleeve and being externally configurable to selectively control flow of the fluid from the screen through the at least one flow passage to the at least one opening defined in the basepipe.

6. The apparatus of claim 5, wherein the at least one valve is externally configurable between first and second states, the at least one valve in the first state permitting fluid communication to the at least one opening, the at least one valve in the second state preventing fluid communication to the at least one opening.

7. The apparatus of claim 6, wherein the at least one valve comprises a nozzle orifice restricting the flow of the fluid in the first state of the at least one valve through the at least one flow passage.

8. The apparatus of claim 5, wherein the at least one valve comprises a ball valve having an orifice defined therein and being rotatable relative to the at least one flow passage, the rotation of the ball valve being externally accessible on the exterior of the sleeve and changing fluid communication through the at least one flow passage.

9. The apparatus of claim 1, wherein the at least one flow passage comprises a nozzle disposed therein and being selectively configurable from an open state without a pin disposed in the nozzle and a closed state with the pin disposed in the nozzle.

10. The apparatus of claim 1, wherein the sleeve defines at least one external opening communicating with the at least one flow passage; and wherein the apparatus further comprises:

at least one set of first and second inserts selectively insertable in the at least one external opening in the sleeve relative to the at least one flow passage, the first insert selectively preventing the flow of the fluid from the screen through the at least one flow passage to the at least one opening defined in the basepipe, the second insert selectively preventing the flow of the fluid from the screen through the at least one flow passage to the at least one opening defined in the basepipe.

11. The apparatus of claim 10, wherein the at least one set of the first and second inserts are each selectively affixable in the at least one external opening.

12. The apparatus of claim 1, wherein the sleeve comprises:

an intermediate body having the at least one flow passage and the shelf of the sleeve;

a first housing portion disposed about the basepipe between an end-ring of the screen and the intermediate body, the first housing portion enclosing a first chamber for passage of the fluid to the at least one flow passage; and a second housing portion disposed about the basepipe from the intermediate body and enclosing the at least one inner chamber for passage of the fluid from the at least one flow passage to the at least one opening in the basepipe.

13. The apparatus of claim 12, wherein the second housing encloses the at least one baffle disposed on the shelf of the sleeve.

14. The apparatus of claim 1, wherein the sleeve comprises:

a body having the at least one flow passage and the shelf of the sleeve, the body having a first end disposed against an end-ring of the screen; and a housing portion disposed about the basepipe from a second of the body and enclosing the at least one inner chamber for passage of the fluid from the at least one flow passage to the at least one opening in the basepipe.

15. The apparatus of claim 1, wherein the sleeve comprises:

a body having the at least one flow passage and having the shelf;

a first housing portion disposed about the basepipe between an end-ring of the screen to an intermediate portion of the body, the first housing enclosing communication of the fluid from the at least one screen; and a second housing portion disposed about the basepipe from the intermediate portion of the body and enclosing the at least one inner chamber in communication with the at least one opening in the basepipe.

16. A flow control method for a borehole comprises:

selectively configuring one or more flow devices disposed in one or more flow passages of a sleeve on a basepipe;

deploying the basepipe in the borehole;

receiving fluid in the sleeve from outside the basepipe;

controlling flow of the received fluid through the one or more flow passages to one or more inner chambers enclosed in communication with one or more internal openings in the basepipe using the one or more flow devices; and changing the flow exiting in a longitudinal direction from the one or more flow passages to a lateral direction before allowing the flow to enter the one or more inner chambers in fluid communication with the one or more internal openings of the basepipe by using at least one baffle disposed on a shelf of the sleeve extending downstream from the one or more flow passages and covering a portion of the basepipe upstream of the one or more internal openings.

17. The method of claim 16, wherein the at least one baffle is at least partially composed of an erosion-resistant material.

18. The method of claim 16, wherein selectively configuring the one or more flow devices disposed in the sleeve on the basepipe comprises selectively permitting or preventing fluid communication to the one or more internal openings through the one or more flow devices.

19. The method of claim 16, wherein selectively configuring the flow devices disposed in the sleeve on the basepipe comprises selectively opening or closing fluid communication through the one or more flow devices by externally opening or closing an internal valve of the one or more flow devices.

20. The method of claim 16, wherein selectively configuring the one or more flow devices disposed in the sleeve on the basepipe comprises selectively opening or closing fluid communication through the one or more flow devices by selectively inserting one of a set of inserts in an external opening of the sleeve on the basepipe.

* * * * *